US006155480A

United States Patent [19]

Botsford et al.

[11] Patent Number: 6,155,480

[45] Date of Patent: Dec. 5, 2000

[54] DISPOSABLE CARTON AND BLANK THEREFOR

[75] Inventors: Charles W. Botsford; Marc Fagelman, both of Akron; Donald W. Hart, Cuyahoga Falls, all of Ohio

[73] Assignee: Gojo Industries, Inc., Akron, Ohio

[21] Appl. No.: 09/374,288

[22] Filed: Aug. 16, 1999

[51] Int. Cl.[7] ..... B65D 5/42; B65D 5/54

[52] U.S. Cl. ..... 229/122.1; 221/305; 229/116.1; 229/242

[58] Field of Search ..... 229/106, 116.1, 229/122.1, 242; 221/305; 222/183, 541.5

[56] References Cited

U.S. PATENT DOCUMENTS

| | | | |
|---|---|---|---|
| 1,986,101 | 1/1935 | Brodsky | 229/122.1 |
| 2,218,670 | 10/1940 | Bennett | 222/183 |
| 4,621,749 | 11/1986 | Kanfer | 222/153 |
| 4,899,929 | 2/1990 | Grollman | 229/122.1 |
| 5,265,772 | 11/1993 | Bartasevich | 222/214 |
| 5,370,267 | 12/1994 | Schroeder | 222/1 |
| 5,443,236 | 8/1995 | Bell et al. | 248/311.3 |
| 5,465,877 | 11/1995 | Bell et al. | 222/181.2 |
| 5,605,279 | 2/1997 | Adamek | 229/116.1 |
| 5,625,659 | 4/1997 | Sears | 377/21 |

FOREIGN PATENT DOCUMENTS

| | | | |
|---|---|---|---|
| 1057262 | 3/1954 | France | 229/122.1 |

*Primary Examiner*—Gary E. Elkins
*Attorney, Agent, or Firm*—Reese Taylor

[57] ABSTRACT

A blank of foldable material capable of being assembled into a carton having a contoured top front surface and the carton formed thereby is disclosed. The carton is intended to be utilized in a dispenser having a back plate and a front cover with the front cover being hingedly attached to the back plate so as to be moveable between open and closed positions and, in the closed position, to contain the components such as the carton. The particular type of dispenser for which the carton is design is one in which the top portion of the cover tapers adjacent its top end toward the back plate when closed. The blank includes a generally rectangular blank of material having top, bottom and first and second opposed side edges with three fold lines spaced inwardly from and parallel to the edges so as to form there between front and rear side walls and first and second side walls. The various walls include projecting flaps from their top and bottom edges and when folded and assembled the top portion of the front wall is capable of being attached to the top flap of the rear wall. Arcuate cut-out areas are provided on the edges of the first and second side walls adjacent to the fold line connecting them to the front wall so that the top portion of the front wall may be formed in either a curvilinear or arcuate position or an angular one so as to reduce the depth of the carton adjacent its front end. This configuration is generally complemental to the configuration of the top portion of the dispenser cover so as to maximize the space available in the interior of the dispenser.

7 Claims, 6 Drawing Sheets

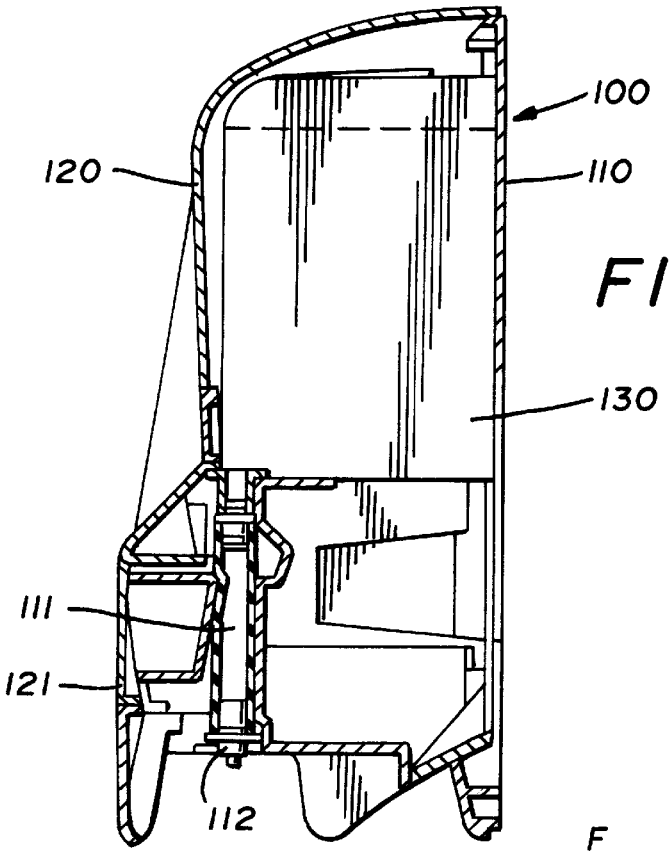
FIG. 9
FIG. 10
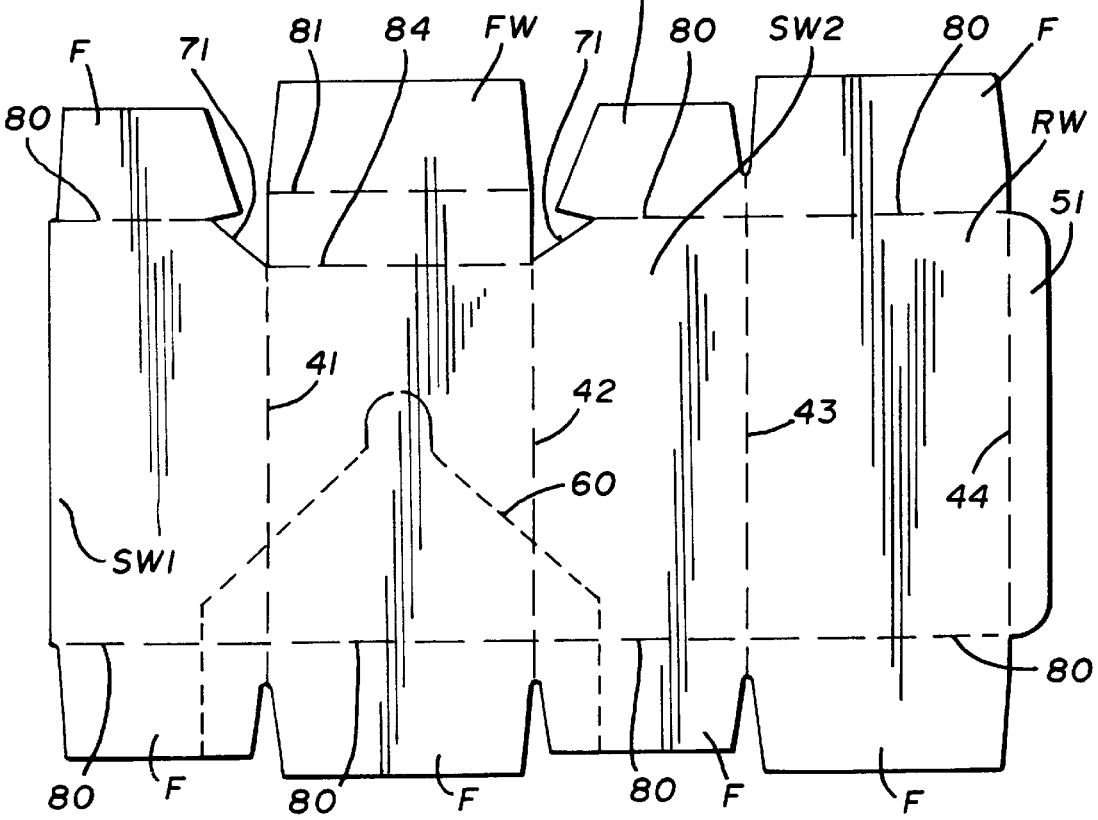

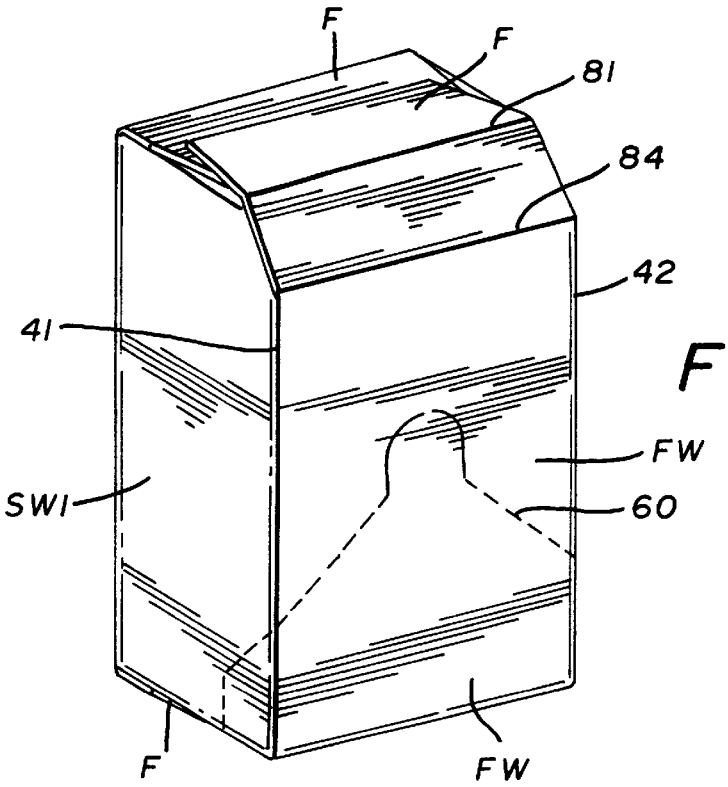
FIG. 11
FIG. 12
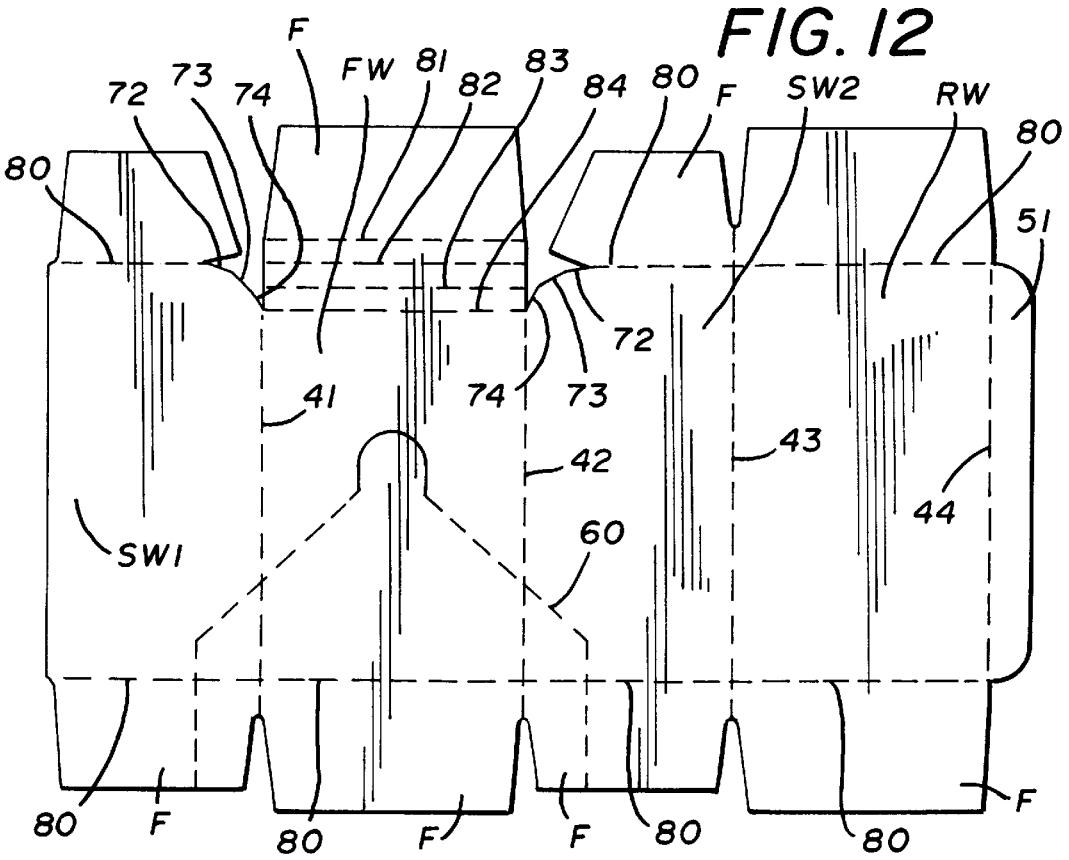

DISPOSABLE CARTON AND BLANK THEREFOR

RELATED PATENT APPLICATIONS

None.

FIELD OF THE INVENTION

This invention relates in general to cartons and relates in particular to the type of carton designed to hold a collapsible bag of flowable material so that the bag and box or carton may be inserted into a wall-mounted dispenser for such material to replenish the dispenser.

BACKGROUND OF THE INVENTION

In dispensing soaps, lotions and other skin and hand care materials of a flowable nature, it is well known in the art to provide wall-mounted dispensers with replaceable cartridges. Generally speaking, these dispensers include a back panel which is secured to the wall or other vertical surface and a front cover hingedly secured to the back plate, usually adjacent its bottom edge, so as to be movable between open and closed positions. In this fashion, with the cover closed, a chamber is formed within the interior of the dispenser.

This chamber within the interior of the dispenser receives a removable cartridge of some sort which contains a quantity of the material to be dispensed and, of course, the cartridge is replaceable when its contents are exhausted.

Also, in general, presently, the most common type of replacement cartridges are the so-called bag-in-box type. These include a box or carton fabricated from cardboard or some other suitable material which has front, back and sidewalls and is generally cubical in outside configuration. Within the box is a collapsible bag of material with a tube and pump arrangement affixed thereto which can be used in cooperating with the dispenser to dispense the material. The boxes or cartons generally have a tearaway portion on the front wall so that the tube and pump can be released once the box is placed inside the dispenser.

Generally, the dispensers are intended to be more or less permanently mounted on walls in restrooms and adjacent other areas in which individuals are likely to require soap, lotion, or other materials of that general nature.

Inasmuch as the dispensers per se become a more or less permanent part of the fixtures in the washroom or other area in which they are mounted, it is desirable to provide them with a pleasing aesthetic appearance. In recent years, dispensers of this type have been aesthetically designed so as to present such an appearance and this often includes what might be called streamlining. That is, the front cover is generally sloped from its bottom to its top, provided with rounded edges and otherwise designed so as to present a pleasing visual effect.

The difficulty encountered in practice, however, is that some of the interior space of the dispenser is wasted. That is, due to the streamlined configuration of the dispenser and particularly the cover thereof, the size of the box and thus the size and amount of material contained in the usual cubical box is limited so as to avoid interference with the tapered, sloping or otherwise contoured surface of the cover when the cover is closed.

Accordingly, it has been found that it is advantageous to provide a box which more or less conforms to the contours of the dispenser cover and in this way increases the volume of material which can be packaged in each box. This enables more efficient utilization of the interior space available and has the advantage of reducing the number of times the dispenser needs to be serviced with a refill.

SUMMARY OF THE INVENTION

It has been found that the objects above set forth can be achieved by providing a box which is generally cubical in outside configuration, but which has a reduced depth top corner.

It has been found that this can be accomplished by providing generally rectangular back walls which have arcuate corners adjacent their front top edges and providing a front wall which has a top flap which can be flexed so as to be in registry with these arcuate front top edges and, thus, close off the top of the box and present a box which has a rectangular back, but which has front and sidewalls which are contoured to complement the contours of the cover.

It has been found that, in this way, the amount of material which can be packaged in such box, while still accommodating and fitting precisely within the confines of the generally used dispensers, can be increased as much as 25%.

It has also been found that a blank can be provided from which to form such carton, the blank having a generally rectangular planar configuration and a plurality of score lines so that the blank can be folded so as present the finished contours above described.

It has further been found that such a blank can be provided by forming a junction of the fold lines and the tops of the sidewalls in an arcuate condition with notched-out surfaces and providing the portion of the blank which forms the front wall with an extended top flap which simply bends around during assembly to conform to the contours of the notched, arcuate areas in the sidewalls.

Accordingly, production of an improved carton and a blank from which it can be fabricated of the character above described becomes the principal object of this invention with other objects thereof becoming more apparent upon a reading of the following brief specification considered and interpreted in view of the accompanying drawings.

BRIEF DESCRIPTION OF THE DRAWINGS

FIG. 9 is a side elevational view, in section, of a typical dispenser with a replacement cartridge in place;

FIG. 10 is a plan view of a blank showing a modified form of the invention;

FIG. 11 is a perspective view showing the assembled carton of FIG. 9;

FIG. 12 is a plan view of a blank of a still further modified form of the invention.

BRIEF DESCRIPTION OF THE PREFERRED EMBODIMENTS

Figure 1:
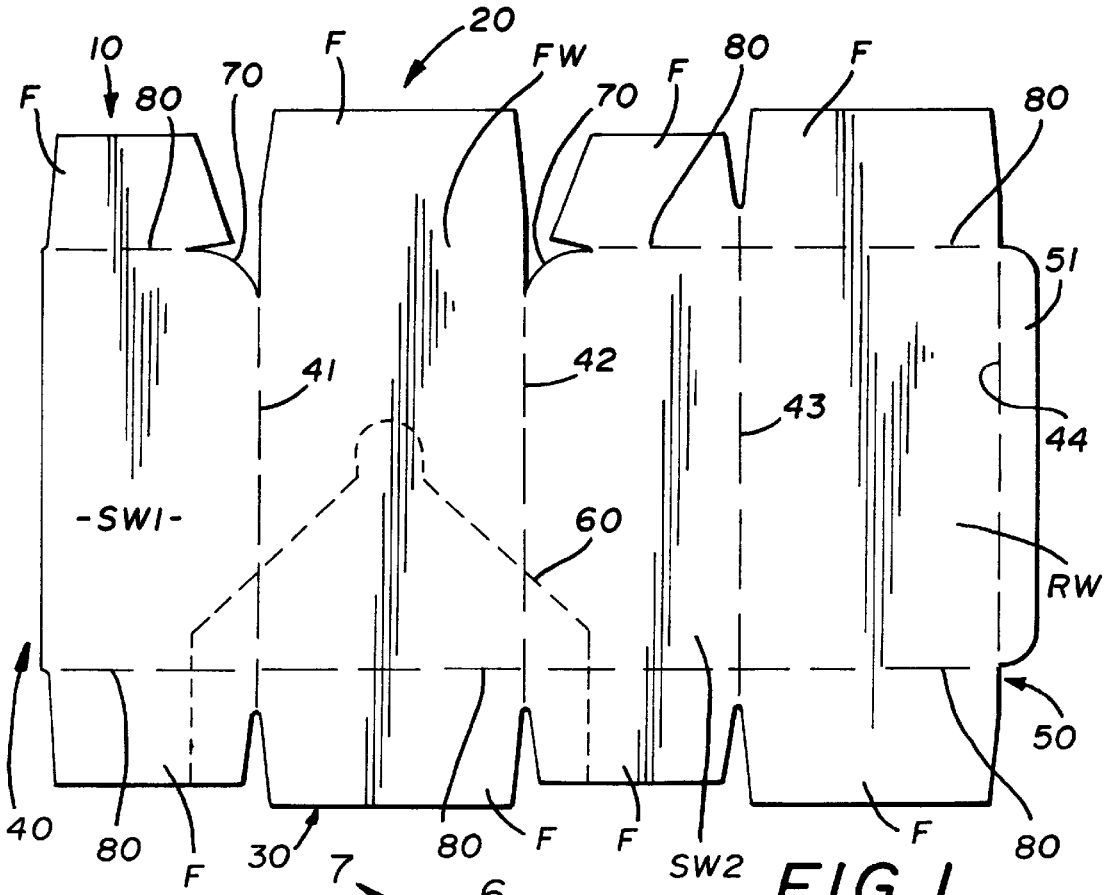
FIG. 1 is a plan view of the blank from which the carton is formed.

Turning first to FIG. 1, it will be seen that the blank from which the carton 10 is formed is generally rectangular in overall planar configuration and includes top and bottom edges 20 and 30 and side edges 40 and 50. A plurality of score or fold lines 41, 42, 43 and 44 extend in parallel condition with respect to the sidewalls 40 and 50 so that the box may be folded to the configuration of FIG. 2.

The side edge 40 and the first score line 41 define a first sidewall SW1 of the finished carton, while the first score line 41 and second score line 42 define the front wall FW of the finished product.

The second score line 42 and third score line 43 define a second sidewall SW2 of the finished product, while the score line 43 and the side edge 50 define the rear wall or back wall RW of the finished product.

Each of the walls has top and bottom flaps F which extend from their longitudinal ends, and suitable transverse score lines 80 are provided in association with these flaps so that the flaps can be bent over to close off the interior of the container, as can be clearly seen in FIGS. 3 through 8 of the drawings.

A perforation line 60 is also provided. As previously mentioned, these cartons are generally intended to enclose a collapsible bag of material and that bag has a pump/tube which is normally folded inside the container, but once the carton is placed within the dispenser, this portion is separated and torn away so that the tube may be extended so as to fit into the dispenser for dispensing the product.

In that regard, FIG. 9 shows an example of one type of dispenser into which such a carton is positioned. It will be seen that the dispenser 100 includes a back plate 110 and a front cover 120. As previously mentioned, a collapsible tube 111 depends from the bag and box 130 so that actuation of handle 121 can collapse the tube 111 to dispense material through nozzle 112.

As can be seen, however, due to the taper of cover 120, a conventional box or carton can extend only so far toward the top of the dispenser. That is, the front corner, if squared off conventionally, as shown in broken lines, would interfere with closing of the cover if extended. Thus, the size of the carton and the amount of material per refill is limited.

Particular attention is called again to FIG. 1 of the drawings in which it will be seen that each of the carton sidewalls, defined by edge 40 and first score line 41 and second and third score lines 42 and 43, has an arcuate cutout and notched portion 70. In this fashion, when the blank is folded to the container, as can be seen, for example, in FIGS. 2, 3 and 6 of the drawings, these arcuate areas face the top of the finished carton 10.

Figure 2:
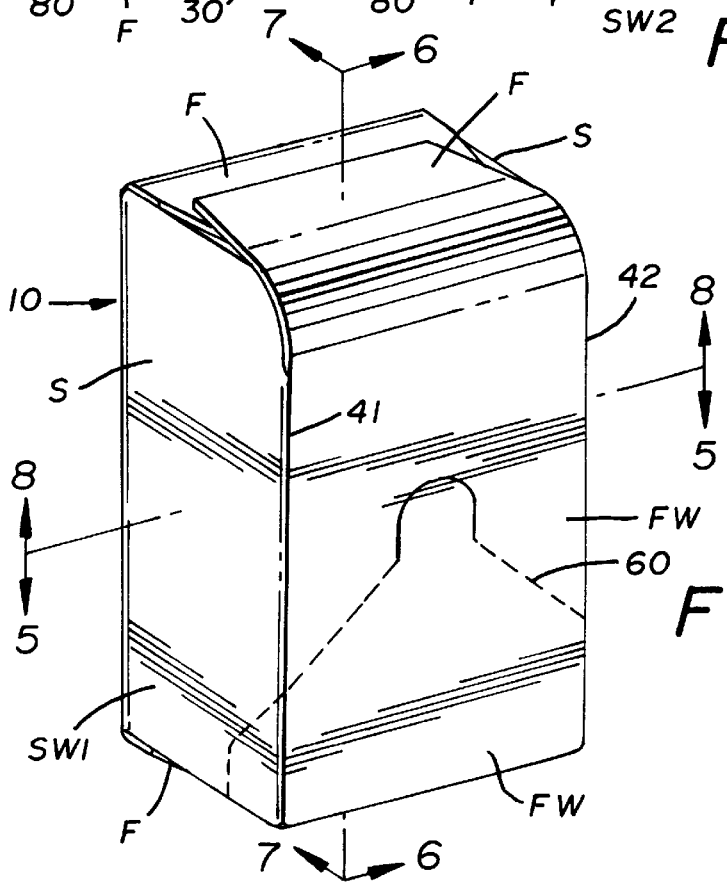
FIG. 2 is a perspective view of the formed carton.
Figure 3:
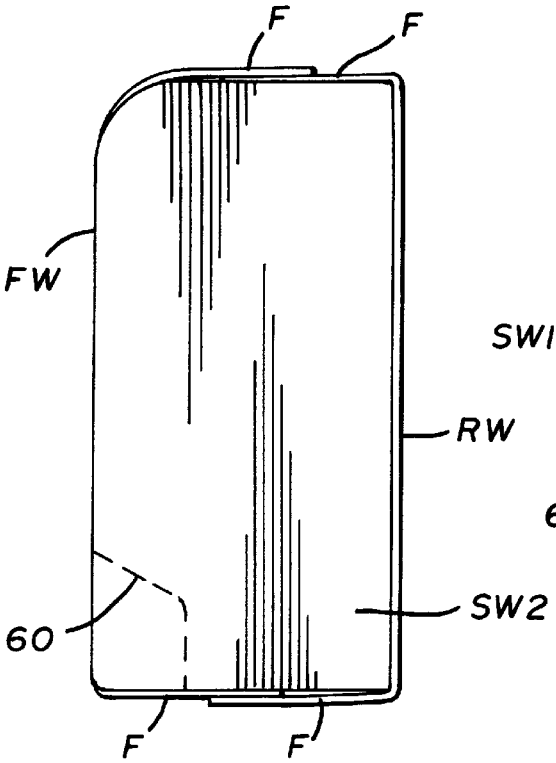
FIG. 3 is a side elevational view of the formed carton.
Figure 4:
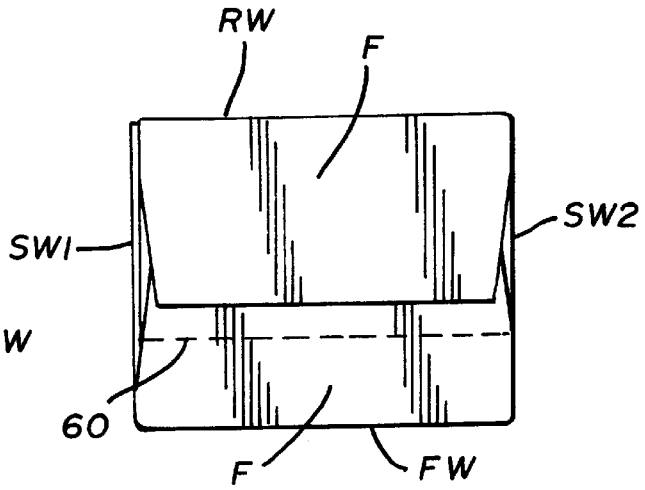
FIG. 4 is a bottom plan view of the assembled carton.
Figure 5:
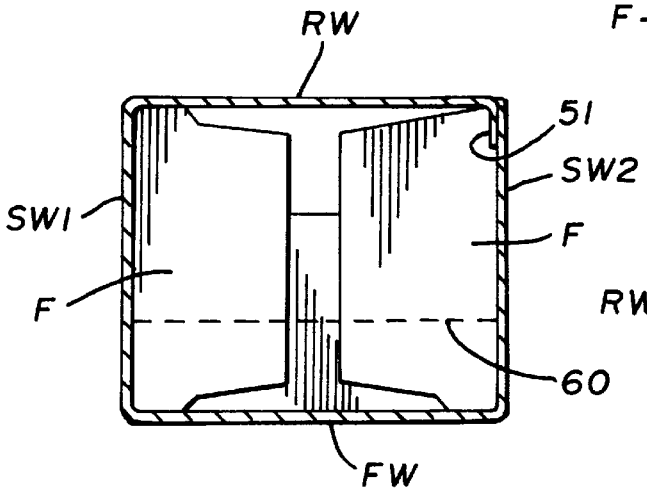
FIG. 5 is a sectional view taken along the line 5—5 of FIG. 2.
Figure 6:
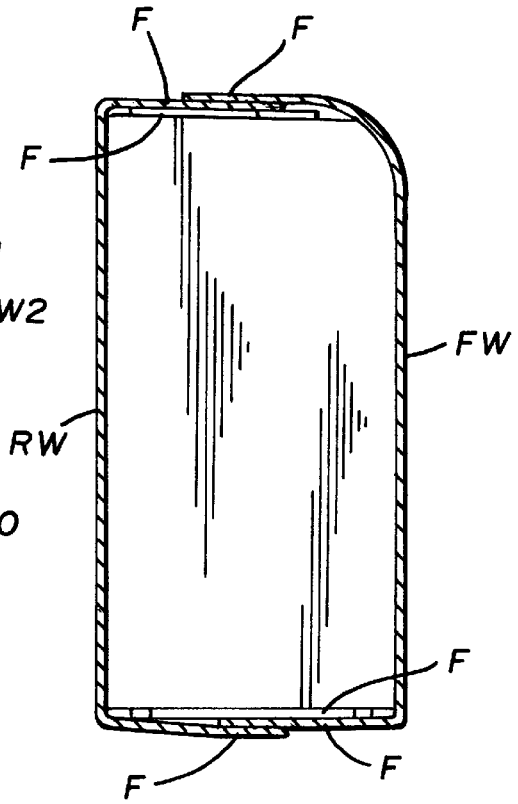
FIG. 6 is a sectional view taken along the line 6—6 of FIG. 2.
Figure 7:
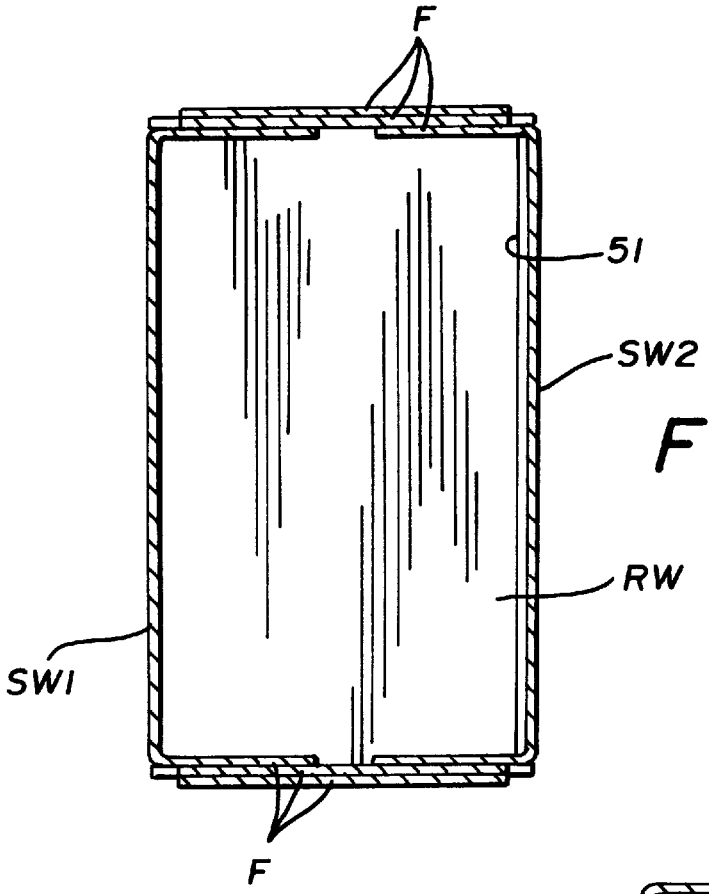
FIG. 7 is a sectional view taken along the line 7—7 of FIG. 2.
Figure 8:
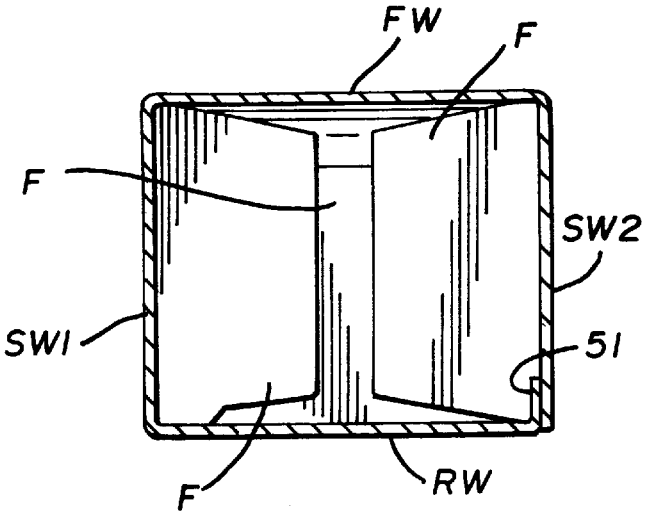
FIG. 8 is a sectional view taken along the line 8—8 of FIG. 2.

The front wall, defined between score lines 41 and 42, also has a top flap, and this top flap is elongated so that when the top flap of the rear wall is folded in, as can be seen in FIGS. 2, 3 and 6 of the drawings, the top flap of the front wall FW can be folded into overlying relationship with the top flap of the rear wall and extends substantially toward the rear wall. This flap simply is bent and then glued or otherwise affixed to the flap of the rear wall and is bent to conform to the arcuate configuration of the cutout area 70,70 in the sidewalls. As can be seen in FIG. 2 of the drawings, this presents a streamlined configuration and one which complements the interior contour of the cover of the dispenser itself.

As can be seen in FIG. 1, a fourth score line 44 is also provided inboard of side edge 50 and a gluing flap 51 is attached to the rear wall along the score line 44 so that when the carton is assembled about the collapsible bag, it can be glued to the sidewall defined between the first edge 40 and the first score line 41. The result, of course, is a compact container which affords the possibility of increasing the volume of material which can be stored in a conventional container.

FIGS. 10 and 11 of the drawings show a modified form of the invention in which, rather than the arcuate areas 70,70 at the top of the sidewalls, a sloped or inclined edge 71 is provided. Similarly, the top flap of the front wall contains a pair of transverse score lines 81,84 provided in the top flap of the front wall. The assembled carton of this embodiment, while not exactly conformed to the configuration of the dispenser cover, nevertheless achieves similar efficiencies.

Figure 13:
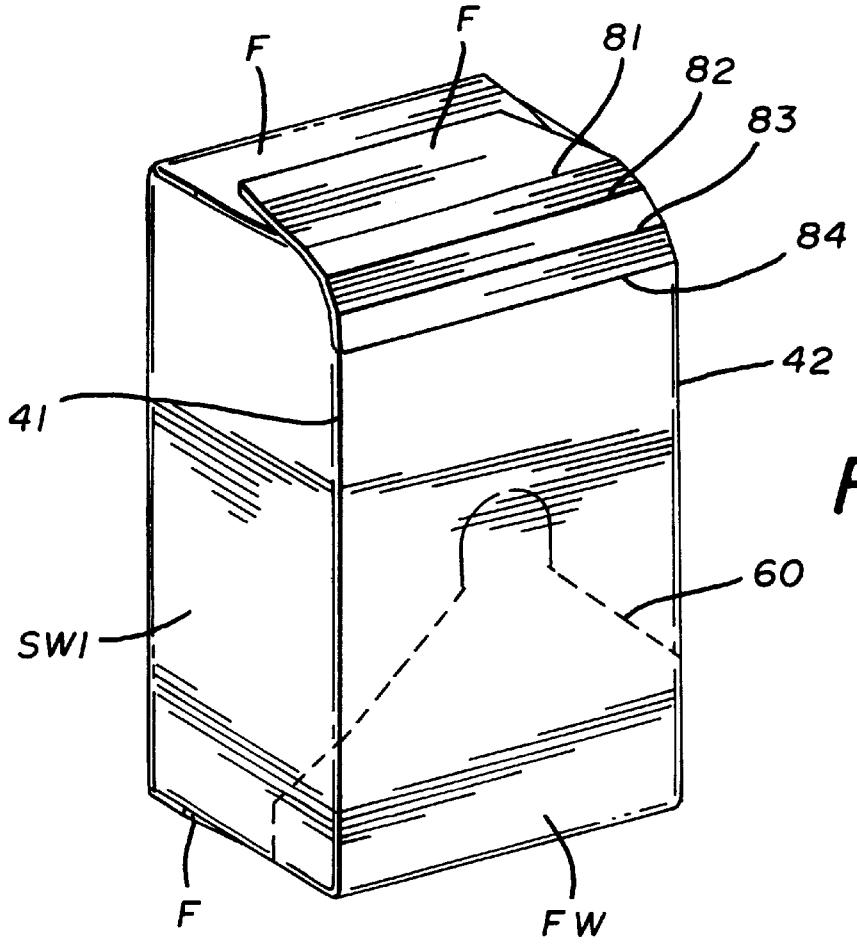
FIG. 13 is a perspective view showing the assembled form of the invention of FIG. 11.

FIGS. 12 and 13 show a still further alternative embodiment wherein the tops of the sidewalls are provided with a series of short, straight lines 72,73,74, and a series of appropriate transverse score lines 81,82,83,84 are provided in the blank in the flap F of the front wall FW so that a stepped arrangement is provided. Again, however, a significant increase in height of the carton is made possible because this, too, will generally conform to the interior configuration of the front cover of the dispenser.

While a full and complete description of the invention has been set forth in accordance with the dictates of the patent statutes, it should be understood that modifications can be resorted to without departing from the spirit hereof or the scope of the appended claims.

What is claimed is:

1. A unitary blank of foldable material for forming a carton, comprising:

(a) a generally rectangular blank of material having a top edge, a bottom edge and first and second opposed side edges;

(b) a first fold line spaced inwardly from and disposed parallel to said first edge;

(c) a second fold line spaced from said second fold line and disposed parallel thereto;

(d) a third fold line spaced from said second fold line and disposed parallel thereto;

(e) said first fold line and said first edge defining a first sidewall of the carton;

(f) said first fold line and said second fold line defining a front sidewall of the carton;

(g) said second fold line and said third fold line defining a second sidewall of the carton;

(h) said third fold line and said second edge defining a back sidewall of the carton;

(i) said front sidewall, back sidewall, and first and second sidewalls having flaps projecting from their top and bottom ends to define top and bottom walls; and (j) said first and second sidewalls having an arcuate cutout area between said first and second fold lines and said second and third fold lines respectively and their associated top flaps.

2. The blank of claim 1 wherein transverse fold lines are provided inboard from said top and bottom edges to define top and bottom flaps.

3. The blank of claim 1 further characterized by the presence of a fourth fold line spaced between said third fold line and said second edge to define a gluing flap.

4. A carton assembly formed from a unitary sheet of foldable material, comprising:

(a) the carton having a plurality of fold lines defining a bottom wall, first, second, third and fourth sidewalls and a top wall;

(b) said first sidewall having a lower portion and an upper portion foldable into a flap overlying said bottom wall;

(c) said second sidewall being disposed in opposed relationship with said first sidewall and having a lower portion disposed parallel to said lower portion of said first sidewall and an upper portion bendable so as to overlie said flap portion of said first sidewall; and (d) said upper portion of said second sidewall forming a curvilinear surface from its junction with said lower portion of said second sidewall to its end overlying said flap.

5. A carton formed from a unitary sheet of material for use with a dispenser having an elongate back plate and an elongate front cover, one end of the cover being attached to one end of the back plate, the cover having a tapered opposed end which engages the opposed end of the back plate comprising:

(a) an elongate front wall;

(b) an elongate rear wall;

(c) opposed, elongate side walls interconnecting said front and rear walls;

(d) a bottom wall interconnecting a first end of the front, rear and side walls;

(e) a top portion of said front wall interconnecting with said rear wall at a second end thereof; and (f) the top portion of said front wall which interconnects with said rear wall being contoured complementally with the tapered end of the front cover of the dispenser front cover.

6. The carton of claim 5 wherein said top portion of said front wall and said top portion of said rear wall form a curvilinear surface.

7. The carton of claim 5 wherein said top portion of said front wall and said top portion of said rear wall form an angular surface.

* * * * *